US011517096B2

(12) United States Patent
Watson

(10) Patent No.: US 11,517,096 B2
(45) Date of Patent: Dec. 6, 2022

(54) COSMETIC RETRIEVAL DEVICE

(71) Applicant: MLD & CO. PTY LTD, Brisbane (AU)

(72) Inventor: Aleesha Watson, Brisbane (AU)

(73) Assignee: MLD & CO. PTY LTD, Brisbane (AU)

( * ) Notice: Subject to any disclaimer, the term of this patent is extended or adjusted under 35 U.S.C. 154(b) by 475 days.

(21) Appl. No.: 16/620,468

(22) PCT Filed: Jun. 8, 2018

(86) PCT No.: PCT/AU2018/050572
§ 371 (c)(1),
(2) Date: Dec. 6, 2019

(87) PCT Pub. No.: WO2018/223195
PCT Pub. Date: Dec. 13, 2018

(65) Prior Publication Data

US 2020/0221853 A1 Jul. 16, 2020

(30) Foreign Application Priority Data

Jun. 9, 2017 (AU) ..... 2017902204

(51) Int. Cl.
*A45D 40/00* (2006.01)

(52) U.S. Cl.
CPC ..... *A45D 40/00* (2013.01); *A45D 2040/0006* (2013.01)

(58) Field of Classification Search
CPC ..... A45D 40/00; A45D 2040/0006; A45D 34/042; A45D 34/043; A45D 34/045; A45D 40/262; A45D 40/264; A45D 40/265

(Continued)

(56) References Cited

U.S. PATENT DOCUMENTS 2,828,502 A 4/1958 Tupper
6,280,112 B1 * 8/2001 Vieu ..... A45D 34/042 401/122

(Continued)

FOREIGN PATENT DOCUMENTS

JP 2007-7242 A 1/2007

OTHER PUBLICATIONS

PCT International Search Report and Written Opinion dated Aug. 31, 2018, International Application No. PCT/AU2018/050572, pp. 1-11.

(Continued)

*Primary Examiner* — David J Walczak
(74) *Attorney, Agent, or Firm* — MH2 Technology Law Group LLP

(57) ABSTRACT

A cosmetic retrieval device for retrieving cosmetic product from a container, the device comprising: a handle adapted for being gripped by a user; a head with a flexible wiping member extending outwardly therefrom, the wiping member having a substantially wedge shaped configuration for wiping inner walls of the container for retrieving product during use; a neck extending between the handle and the head, the neck comprising a proximal neck portion located adjacent the head; a distal neck portion located adjacent the handle wherein the proximal neck portion is narrower than the distal neck portion and wherein thickness of the curved neck portion gradually decreases from the distal neck portion to the proximal neck portion.

18 Claims, 5 Drawing Sheets

(58) Field of Classification Search
USPC ..... 401/126–130; 15/143.1, 104.16, 104.18, 15/236.01, 236.09
See application file for complete search history.

(56) References Cited

U.S. PATENT DOCUMENTS

| | | | | |
|---|---|---|---|---|
| 2004/0161285 | A1* | 8/2004 | Gueret | A45D 34/04 401/122 |
| 2006/0013639 | A1* | 1/2006 | Gueret | A45D 34/045 401/122 |
| 2006/0239757 | A1* | 10/2006 | Giniger | A61M 35/006 401/126 |
| 2011/0191975 | A1 | 8/2011 | Genatossio et al. | |
| 2013/0313847 | A1 | 11/2013 | Tortatice | |
| 2015/0250361 | A1 | 9/2015 | Marion | |

OTHER PUBLICATIONS

PCT International Preliminary Report on Patentability dated Dec. 5, 2018, International Application No. PCT/AU2018/050572, pp. 1-15.

* cited by examiner

COSMETIC RETRIEVAL DEVICE

CROSS-REFERENCE TO RELATED APPLICATION(S)

This application is a national stage entry from International Application No. PCT/AU2018/050572, filed on Jun. 8, 2018, in the Receiving Office ("RO/IB") of Australia ("AU"), and published as International Publication No. WO 2018/223195 A1 on Dec. 13, 2018; International Application No. PCT/AU2018/050572 claims priority from Australian Patent Application No. 2017902204, filed on Jun. 9, 2017, in the Australian Patent and Trademark Office, the entire contents of all of which are incorporated herein by reference.

TECHNICAL FIELD

This invention relates to a device for retrieving a product particularly a cosmetic product from a container that is difficult to reach and retrieve.

BACKGROUND

The discussion of any prior art documents, techniques, methods or apparatus is not to be taken to constitute any admission or evidence that such prior art forms, or ever formed, part of the common general knowledge.

Cosmetic and beauty products such as foundation are typically packaged in containers, having a variety of shapes and sizes. Certain products such as foundation are usually packaged in a generally cylindrical glass or plastic containers with a relatively small diameter (typically between 1 cm to 1.5 cm). Cosmetic products can be viscous and often a substantial quantity of the product may stick to the inner walls of the container. Therefore, the shape or configuration of the container in combination with the viscous or sticky nature of cosmetic products renders a certain portion of the product inside the container generally unusable and often disposed. Some cosmetic products are packaged in containers with a cap that incorporates a pump and an applicator. However, such pumps and applicators are unable to retrieve cosmetic products in hard to reach portions of the container. Further, the applicator and pump are not suitable for retrieving any product which may be sticking to the walls of the container, Cosmetic and beauty products can be very expensive or difficult to obtain and it is desirable for consumers to utilise most if not all of the cosmetic products contained in the container. Accordingly, it is desirable to provide a tool or a device that assists in retrieval and removal of all or most of cosmetic product contents within the container such that a consumer is able to more completely access and use the contents of a cosmetic or beauty product to receive better value and minimise waste.

SUMMARY OF THE INVENTION

In one aspect, the invention provides a cosmetic retrieval device for retrieving cosmetic product from a container, the device comprising:

- a handle adapted for being gripped by a user;
- a head with a flexible wiping member extending outwardly therefrom, the wiping member having a substantially wedge shaped configuration for wiping inner walls of the container for retrieving product during use;

- a neck extending between the handle and the head, the neck comprising a proximal neck portion located adjacent the head; a distal neck portion located adjacent the handle wherein the proximal neck portion is narrower than the distal neck portion and wherein thickness of the neck portion gradually decreases from the distal neck portion to the proximal neck portion.

In an embodiment, the neck comprises a curved or bent neck portion extending between the proximal and distal neck portions.

In an embodiment, the head comprises a top end located away from the proximal neck portion, a bottom end located adjacent to the proximal neck portion and at least one flexible edge portion of the wiping member extending in between the bottom end and top end of the head.

In an embodiment, the head further comprises two spaced apart longitudinal surfaces extending in between the top end and the bottom end.

In an embodiment, the wiping member of the head comprises flexible edge portions including:

- first and second longitudinal flexible edge portions extending between the top end and the bottom end;
- a top flexible edge portion extending at the top end of the head; and
- a bottom flexible edge portion extending at the bottom end portion of the head.

In an embodiment, the neck comprises an attachment portion for receiving the proximal neck portion to attach the wiping member to the neck, the attachment portion being located at the corner of the bottom edge portion and the first longitudinal edge portions.

Preferably, the attachment portion extends transversely relative to the proximal neck portion in a direction of the length of the wiping member.

In an embodiment, the attachment portion comprises a length that is at least half the length of the wiping member and wherein the length of the attachment member is less than the length of the wiping member.

In an embodiment, the wiping member comprises a thickness (t) separating two opposed surfaces of the wiping member.

In an embodiment, the wiping member comprises an opening for receiving the attachment portion in between said opposed surfaces.

In an embodiment, the first longitudinal edge portion has a greater thickness relative to thickness of the second longitudinal edge portion to allow the second longitudinal edge to flex more than the first longitudinal edge of the wiping member.

Preferably, thickness of the flexible wiping member decreases gradually from the first longitudinal edge portion to the second longitudinal edge portion to vary flexibility of the wiping member along a height of the wiping member.

In an embodiment, the bottom edge portion has a greater thickness relative to thickness of the top edge portion to allow the top edge portion to flex more than the bottom edge portion of the wiping member.

Preferably, thickness of the flexible wiping member decreases gradually from the bottom edge portion to the top edge portion to vary flexibility of the wiping member along a length of the wiping member.

In an embodiment, length of said first and/or second longitudinal flexible edge portions is in the range of 15 mm to 25 mm and more preferably in the range of 17 mm to 22 mm and still more preferably 19.5 mm.

In an embodiment, length of said top and/or bottom edge is in the range of 5 mm to 15 mm and more preferably 7 mm to 12 mm and still more preferably 9.7 mm.

In an embodiment, the proximal neck portion extends laterally and downwardly relative to a plane of the wiping member.

In an embodiment, the handle is curved and includes gripping members for receiving a user's hand thereon.

In an embodiment, the handle comprises a bulging middle portion and relatively narrower end portion.

In an embodiment, the wiping member comprises a flexible material for allowing the head to flex relative to the neck and/or handle during use.

In an embodiment, thickness of the proximal neck portion is in the range of 2 mm to 4 mm and thickness of the distal neck portion is in the range of 6 mm to 8 mm.

BRIEF DESCRIPTION OF THE DRAWINGS

The Detailed Description is not to be regarded as limiting the scope of the preceding Summary of the Invention in any way. The Detailed Description will make reference to a number of drawings as follows.

DETAILED DESCRIPTION OF PREFERRED EMBODIMENT

Referring to FIGS. 1 to 6, a cosmetic product retrieval device 100, in accordance with an embodiment of the invention has been illustrated. The device 100 is particularly well suited for retrieving product from a small cylindrical containers (not shown) used for packaging cosmetic products such as foundation creams and the like that is otherwise difficult to reach and retrieve.

Figure 1:
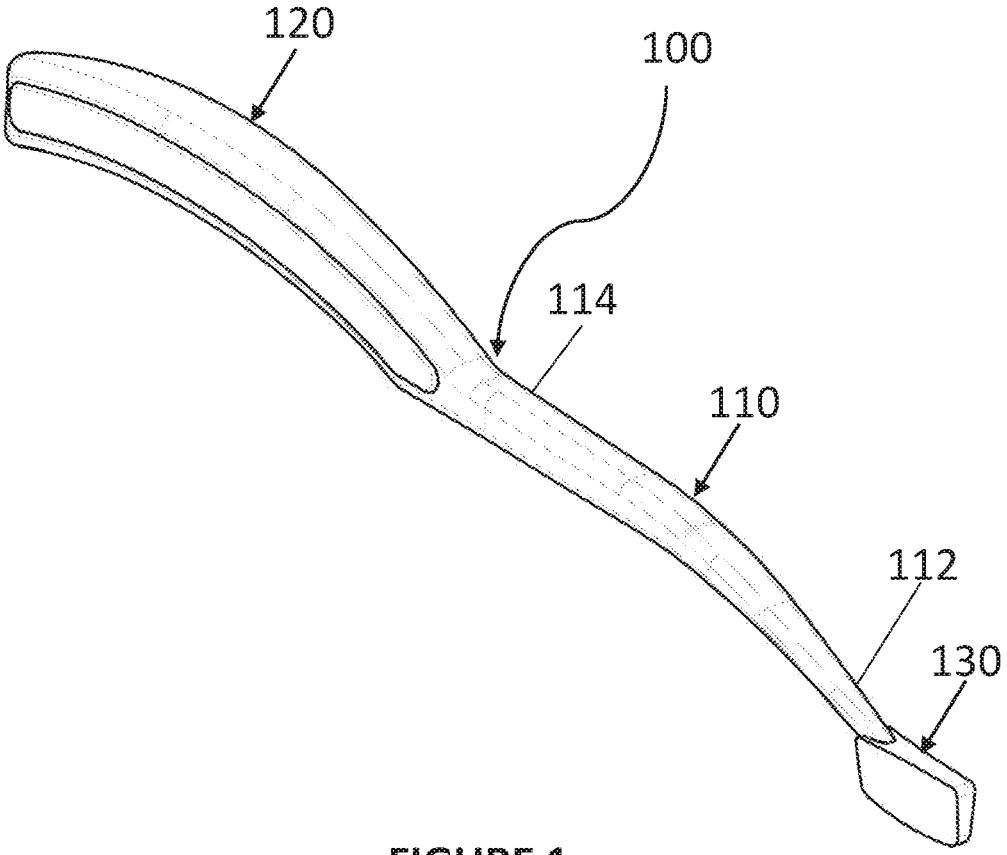
FIG. 1 is a perspective view of a cosmetic retrieval device in accordance with an embodiment of the present invention.

Referring to FIG. 1, the device 100 includes a curved handle 120 with gripping members to allow a user to grip the device 100 during use. The device 100 also comprises a neck 110 that extends between the handle 120 and a product retrieving head having a flexible wiping member 130.

The neck 110 comprises a proximal neck portion 112 located adjacent the wiping member 130 and a distal neck portion 114 located adjacent the handle 120. In the preferred embodiment, the neck 110 is formed integrally with the handle 120 by using moulded polymeric material. The neck 110, particularly a middle portion of the neck 110 is bent along its length. The proximal neck portion 112 is narrower than the distal neck portion 114. The narrower width/thickness allows the proximal neck portion 112 and the attached wiping member 130 to be easily inserted into an opening of a small bottle and retrieve cosmetic product that may be lining the inner walls of the small bottle (not shown). Advantageously, the thickness of the curved or bent neck 110 gradually decreases from the distal neck portion 114 to the proximal neck portion 112. The relatively thicker distal neck portion 114 provides structural strength to the neck 110 and the relatively thinner proximal neck portion 112 allows the wiping member 130 of the head to be easily inserted into a narrow opening of a small bottle.

Figure 2:
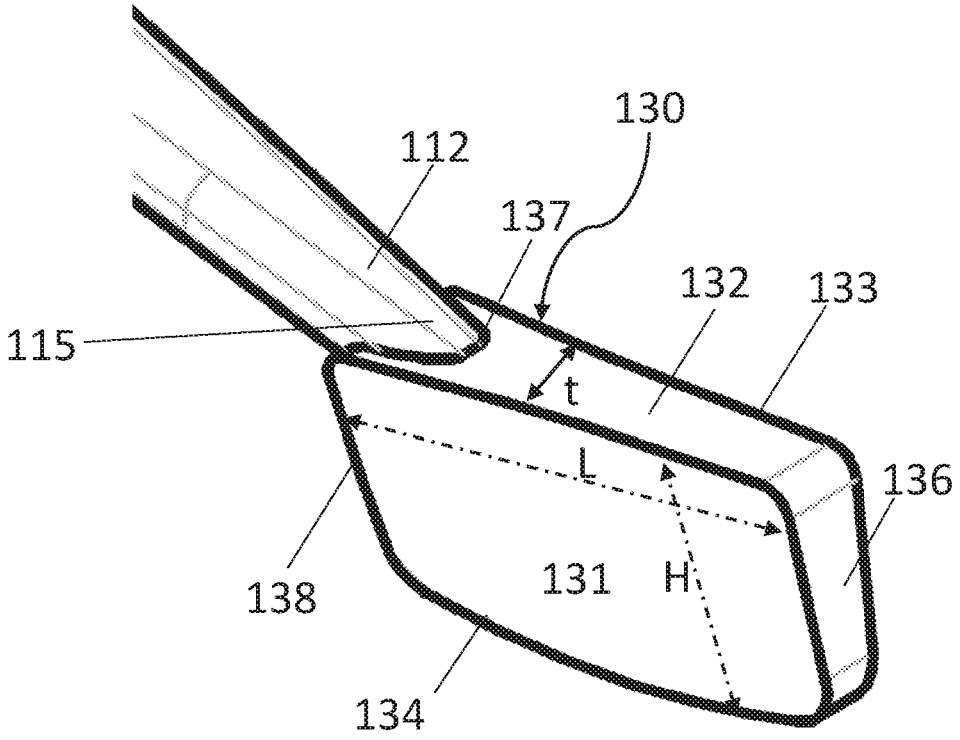
FIG. 2 is an enlarged perspective view of the head 130 of the cosmetic retrieval device 100.
Figure 3:
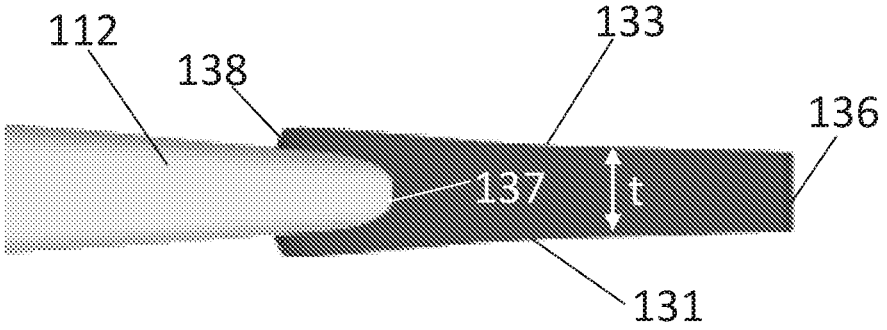
FIG. 3 is an enlarged top view of the head 130 of the cosmetic retrieval device 100.
Figure 4:
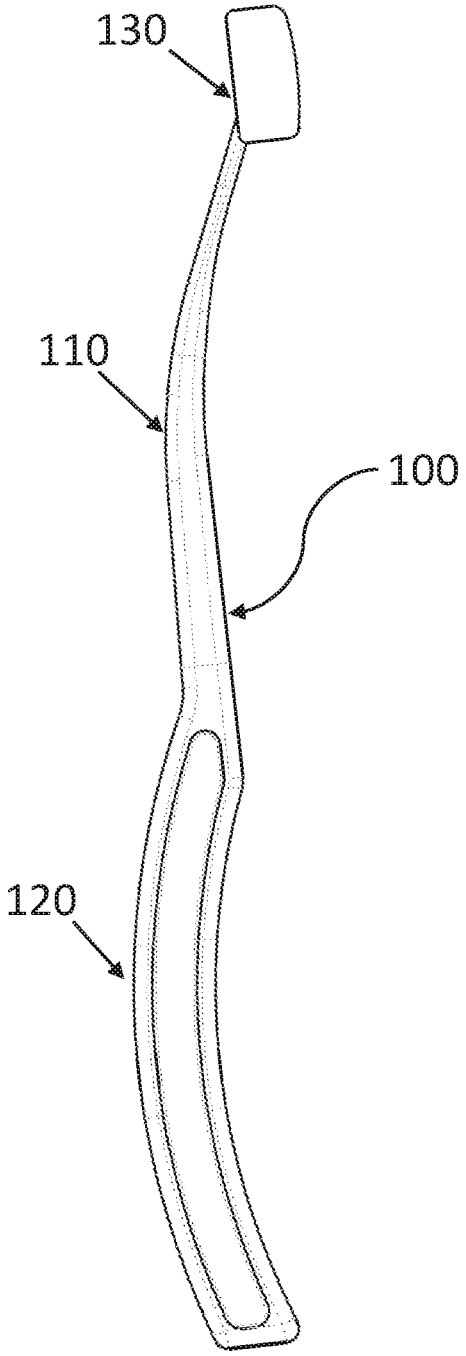
FIG. 4 is a side view of the cosmetic retrieval device 100.
Figure 5:
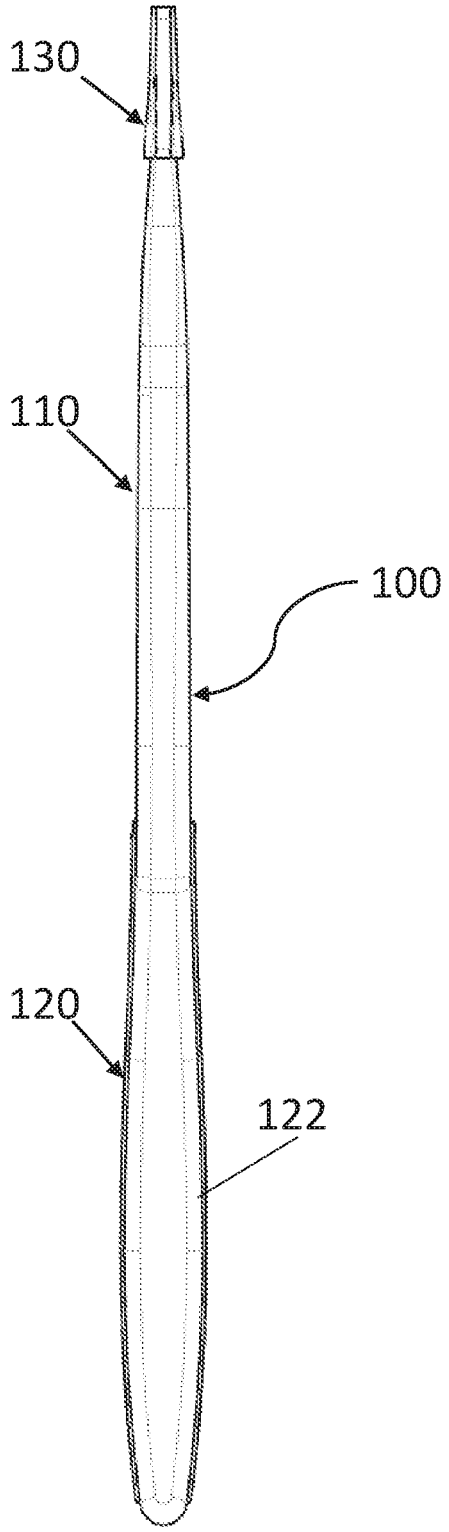
FIG. 5 is a top view of the cosmetic retrieval device 100.
Figure 6:
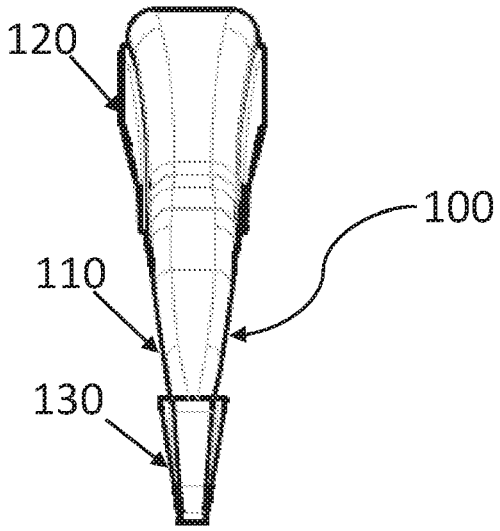
FIG. 6 is a frontal view of the cosmetic retrieval device 100.

Referring to FIGS. 2 and 3, enlarged views of the wiping member 130 that forms part of the head has been shown. The wiping member 130 comprises a top end edge portion 136 located away from the proximal neck portion 112, a bottom end edge portion 138 located adjacent to the proximal neck portion 112 and a longitudinal edge portion 134 that extends between the bottom end 138 and top end 136 of the wiping member 130. The longitudinal edge portion 134 of the wiping member is configured to flex easily to allow the longitudinal edge 134 to be flexed during a wiping action carried out during use. The longitudinal edge portion 134 is opposite a second longitudinal edge 132 which is relatively thicker than the first longitudinal edge 132. The first and second longitudinal edge portions 132 and 134 are oppositely arranged and spaced apart by the top end edge portion 136 and the bottom end edge portion 138.

The size of the wiping member 130 has been selected by the inventor after careful considerations to allow an optimal level of product retrieval capability in combination with ease of ingress into a bottle (that may have a relatively narrow mouth or opening to receive the wiping member 130). The length of the thicker longitudinal edge 132 is approximately 19.5 mm. The thinner longitudinal edge 134 is slightly curved and the curved edge is slightly greater than 19.5 mm. Each of the top edge 136 and the bottom edge 138 is approximately 9.7 mm long.

The neck 110 further comprises an attachment portion 115 that is received into an opening 137 of the wiping member 130 thereby attaching the wiping member 130 to the proximal neck portion 112. The opening 137 in the wiping member 130 is located at the corner of the bottom edge portion 138 and the thicker longitudinal edge 132. The attachment portion 115 extends transversely relative to the proximal neck portion 112 in a direction of the length of the wiping member 130 as denoted by (L). The attachment portion 115 comprises a length that is at least half the length of the wiping member 130. In the preferred embodiment, the length of the attachment portion 115 is greater than half the length of the wiping member 130 but less than the entire length (L) of the wiping member 130.

The wiping member 130 comprises a thickness (t) separating two opposed surfaces 131 and 133 of the wiping member 130. The thickness of the wiping member varies in two directions in the present embodiment. Specifically, the longitudinal edge portion 132 adjacent the proximal neck portion 112 has a greater thickness relative to thickness of the longitudinal edge 134 portion to allow the longitudinal edge 134 to flex more (or by a greater extent) than the thicker longitudinal edge 132 of the wiping member 130. The thickness gradually decreases in a direction from the thicker longitudinal edge 132 towards the thinner longitudinal edge 134 along a height (H) of the wiping member. The bottom edge portion 138 of the wiping member 130 is also relatively thicker when compared to the top edge portion 136 and the thickness of the wiping member 130 decreases in a direction from the bottom end edge portion 138 to the top end edge portion 136.

Providing the wiping member 130 in which the thickness of the wiping member 130 is varied along two mutually perpendicular directions (in a direction from the bottom edge 138 to the top edge 136-thickness decreasing; and in a direction from the thicker longitudinal edge 132 to the thinner longitudinal edge 134) allows variation in the extent of flexibility provided by the wiping member 130 during use. The relatively thinner top edge portion 136 provides greater flexibility and allows the narrower top edge portion 136 to be flexed for retrieving residual cosmetic product that may be lining the base of the small bottle containing the cosmetic product. Similarly, the relatively thinner longitudinal edge portion 134 demonstrates greater flex thereby allowing the thinner longitudinal edge 134 to be used for retrieving residual cosmetic product that may be lining the side walls of the small bottle. The relatively thicker edge portions 132 and 138 provide a lesser extent of flexibility for the wiping member 130. The inventor has found that varying the thickness of the wiping member 130 to provide a relatively thicker portion of the wiping member 130 in close proximity to the proximal neck portion 112 allows greater structural support and improves control for the user holding the handle 120.

The handle 120 is provided with one or more finger receiving members to allow a user to grip the handle 120 and allow the device 100 to be used effectively for retrieving cosmetic product from the cylinder. The handle 120 comprises a central portion 122 that is relatively wider than one or both of the end portions of the handle and provides an increased area that is suitable for use as a gripping surface.

In the preferred embodiment, as shown in FIGS. 1 to 6, the wiping member 130 is made from santoprene (a thermoplastic elastomer) which provides a greater extent of flexibility in comparison with the neck 110 and the handle 120. In the preferred embodiment, the handle 120 and the neck 110 are integrally formed from polypropylene.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

The invention claimed is:

1. A cosmetic retrieval device for retrieving cosmetic product from a container, the device comprising:

a handle adapted for being gripped by a user;

a head with a flexible wiping member extending outwardly therefrom, the wiping member having a wedge shaped configuration for wiping inner walls of the container for retrieving product during use;

a neck extending between the handle and the head, the neck comprising a proximal neck portion located adjacent the head; a distal neck portion located adjacent the handle wherein the proximal neck portion is narrower than the distal neck portion and wherein thickness of the neck portion gradually decreases from the distal neck portion to the proximal neck portion;

wherein the wiping member of the head comprises flexible edge portions including:

a first longitudinal flexible edge portion and a second longitudinal flexible edge portion, wherein both the first longitudinal flexible edge portion and the second longitudinal flexible edge portion extend between a top end of the head and a bottom end of the head;

a top flexible edge portion extending at the top end of the head; and a bottom flexible edge portion extending at the bottom end of the head; and wherein the bottom flexible edge portion has a greater thickness relative to thickness of the top flexible edge portion to allow the top flexible edge portion to flex more than the bottom flexible edge portion of the wiping member.

2. The cosmetic retrieval device in accordance with claim 1 wherein the top end of the head is located away from the proximal neck portion, the bottom end of the head is located adjacent to the proximal neck portion and at least one flexible edge portion of the wiping member extending in between the bottom end and top end of the head.

3. The cosmetic retrieval device in accordance with claim 2 wherein the head further comprises two spaced apart longitudinal sides extending in between the top end and the bottom end.

4. The cosmetic retrieval device in accordance with claim 1 wherein the neck comprises an attachment portion extending from the proximal neck portion to attach the wiping member to the neck, the attachment portion being located at a corner of the bottom flexible edge portion and the first second longitudinal flexible edge portion.

5. The cosmetic retrieval device in accordance with claim 4 wherein the attachment portion extends transversely relative to the proximal neck portion in a direction of a length of the wiping member.

6. The cosmetic retrieval device in accordance with claim 5 wherein the attachment portion comprises a length that is at least half the length of the wiping member and wherein the length of the attachment member is less than the length of the wiping member.

7. The cosmetic retrieval device in accordance with claim 4 wherein the wiping member comprises a thickness (t) separating two opposed surfaces of the wiping member.

8. The cosmetic retrieval device in accordance with claim 7 wherein the wiping member comprises an opening for receiving the attachment portion in between said opposed surfaces.

9. The cosmetic retrieval device in accordance with claim 1 wherein the second longitudinal edge portion has a greater thickness relative to thickness of the first longitudinal flexible edge portion to allow the first longitudinal flexible edge portion to flex more than the second longitudinal edge of the wiping member.

10. The cosmetic retrieval device in accordance with claim 1 wherein thickness of the flexible wiping member decreases gradually from the second longitudinal edge portion to the first longitudinal edge portion to vary flexibility of the wiping member along a height of the wiping member.

11. The cosmetic retrieval device in accordance with claim 1 wherein thickness of the flexible wiping member decreases gradually from the bottom edge portion to the top edge portion to vary flexibility of the wiping member along a length of the wiping member.

12. The cosmetic retrieval device in accordance with claim 1 wherein length of said first longitudinal flexible edge portion, the second longitudinal flexible edge portion, or both the first longitudinal flexible edge portion and the second longitudinal edge portion is in the range of 15 mm to 25 mm or in the range of 17 mm to 22 mm or 19.5 mm.

13. The cosmetic retrieval device in accordance with claim 1 wherein length of said top flexible edge portion, the bottom flexible edge portion, or both the top flexible edge portion and the bottom flexible edge portion is in the range of 5 mm to 15 mm or in the range of 7 mm to 12 mm or 9.7 mm.

14. The cosmetic retrieval device in accordance with claim 1 wherein the proximal neck portion extends laterally and downwardly relative to a plane of the wiping member.

15. The cosmetic retrieval device in accordance with claim 1 wherein the handle is curved and includes gripping members for receiving a user's hand thereon.

16. The cosmetic retrieval device in accordance with claim 1 wherein the handle comprises a bulging middle portion and relatively narrower end portion.

17. The cosmetic retrieval device in accordance with claim 1 wherein the wiping member comprises a flexible material for allowing the head to flex relative to the neck, the handle, or both the neck and the handle during use.

18. The cosmetic retrieval device in accordance with claim 1 wherein the neck comprises a curved or bent neck portion extending between the proximal and distal neck portions.

* * * * *